US005533885A

United States Patent [19]

Schlüsselbauer

[11] Patent Number: 5,533,885

[45] Date of Patent: Jul. 9, 1996

[54] APPARATUS FOR MANUFACTURING ANNULAR OR TUBULAR WORKPIECES FROM CONCRETE

[76] Inventor: Johann Schlüsselbauer, Obergmain 2, A-4674 Altenhof am Hausruck, Austria

[21] Appl. No.: 322,077

[22] Filed: Oct. 12, 1994

[30] Foreign Application Priority Data

Oct. 21, 1993 [AT] Austria ..... 2120/93

[51] Int. Cl.[6] ..... B28B 3/02; B28B 13/02; B28B 21/10

[52] U.S. Cl. ..... 425/185; 425/193; 425/253; 425/258; 425/412; 425/413; 425/457

[58] Field of Search ..... 425/185, 193, 425/195, 253, 258, 413, 412, 426, 452, 454, 457

[56] References Cited

U.S. PATENT DOCUMENTS

| | | | |
|---|---|---|---|
| 3,383,742 | 5/1968 | Nelson | 425/426 |
| 3,726,622 | 4/1973 | DeTroyer et al. | 425/193 |
| 4,248,580 | 2/1981 | Christian | 425/253 |
| 4,265,609 | 5/1981 | Kitahara | 425/260 |
| 4,708,621 | 11/1987 | Schmidgall et al. | 425/253 |
| 5,040,968 | 8/1991 | Kraiss | 425/426 |

FOREIGN PATENT DOCUMENTS

| | | |
|---|---|---|
| 229351 | 11/1985 | German Dem. Rep. . |
| 3704881 | 4/1993 | Germany . |

*Primary Examiner*—James P. Mackey
*Attorney, Agent, or Firm*—Collard & Roe

[57] ABSTRACT

It is desired to simplify the design of an apparatus for manufacturing annular or tubular workpieces from concrete, which comprises a mold having a vertical axis and a mold cavity between a core and a shell. The shell surrounds and is radially spaced from the core, and the mold cavity, is adapted to be filled with concrete from above a feeding and distributing devices is radially guided relative to the mold and serve to feed and distribute the concrete which is to be dispensed into the mold cavity. A mold press, which comprises a vertical ram that carries a mold ring, is adapted to close the mold cavity at its top, and which press is radially displaceable relative to the mold. The feeding and distributing device for the concrete and they the molding press are mounted on a carriage, which is guided to be radially displaceable relative to the mold, and they are arranged on the carriage one behind the other in the direction in which it is displaceable.

4 Claims, 2 Drawing Sheets

APPARATUS FOR MANUFACTURING ANNULAR OR TUBULAR WORKPIECES FROM CONCRETE

BACKGROUND OF THE INVENTION

1. Field of the Invention

This invention relates to an apparatus for manufacturing annular or tubular workpieces from concrete, comprising molding means, which have a vertical axis and between a core and a shell, which surrounds and is radially spaced from the core, define a mold cavity, which is adapted to be filled with concrete from above, feeding and distributing means, which are radially guided relative to the molding means and serve to feed and distribute the concrete which is to be dispensed into the mold cavity, and a molding press, which comprises a vertical ram that carries a molding ring, which is adapted to close the mold cavity at its top, and which press is radially displaceable relative to the molding means.

2. Description of the Prior Art

In apparatuses of that kind the mold cavity of the molding means is filled with concrete by means of the feeding and distributing means before the top end face of the workpiece can be molded in that a molding ring is forced into the annular gap between the core and the shell of the molding means. For that purpose the feeding and distributing means must first be retracted from their operative position in order to provide a space for the molding press, which carries the molding ring. That molding press is subsequently displaced or pivotally moved to a position over the molding means. When it is desired to remove the workpiece from the mold cavity the molding press must be returned to its initial position so that the workpiece can be axially extracted upwardly from the molding means, usually together with the shell, by means of an extracting crane. To minimize the space required for the feeding and distributing means it is known (German Patent Specitication 37 04 881) to arrange the feeding and distributing means for the concrete and the molding press one over the other and to displaceably mount them in a common frame so that the feeding and distributing means and the molding press can individually be displaced to the operative position over the molding means and back to the initial position as is required in the sequence of operations. But that known apparatus for manufacturing annular or tubular workpieces from concrete has the disadvantage that owing to the fact that the molding press is disposed above the feeding and distributing means the ram of the press must perform relatively large strokes and the forces exerted by the press must be taken up by the frame, which supports the molding press as well as the feeding and distributing means, so that heavy structures are required for that frame and for the carriage which carries the press. Besides, the separate drive means required to displace the feeding and distributing means, on the one hand, and the molding press, on the other hand, and the separate means for controlling said displacements involve a high structural expenditure.

SUMMARY OF THE INVENTION

For this reason it is an object of the invention to avoid said disadvantages and so to improve an apparatus for manufacturing annular or tubular workpieces from concrete that relatively small strokes will be sufficient for the ram of the press and that the structure will be simple and requires only a small space.

The object set forth is accomplished in accordance with the invention in that the feeding and distributing means for the concrete and the molding press are mounted on a carriage, which is guided to be radially displaceable relative to the molding means, and are arranged on said carriage one behind the other in the direction in which it is displaceable.

Because the feeding and distributing means for the concrete and the molding press are arranged on a common carriage, only one drive and one contro means are required for the displacement of said two parts. The stroke of the ram of the molding press may be small because the molding press can be displaced to a position closely over the molding means so that a simple, indirect or direct locking can be effected between the molding press and the molding means and that the carriage and the carriage guide will not be subjected to the forces exerted by the press. For this reason the carriage and the carriage guide may consist of lightweight structures. Besides, only a small space is required because the feeding and distributing means and the molding press are mounted on a common carriage so that the molding means remain freely accessible.

The carriage may be guided by various means. But a simple structure will be achieved if the carriage is movable on rails which extend on both sides of the molding means because in that case the carriage can desirably be moved beyond the molding means when the feeding and distributing means are to be operated.

Particularly simple conditions will be obtained in apparatuses in which the molding ring for molding the top end face of the workpiece remains on the workpiece during the extraction of the workpiece so that an additional molding ring is required for manufacturing a new workpiece and must be retained on the ram of the molding press by means of a disengageable retaining coupling. If a support for a stack of such molding rings is provided and is vertically aligned with the molding press when the feeding and distributing means are in their charging position over the molding means, and the distance from such stack to the molding means equals the distance between the feeding and distributing means and the molding press, the movement of the carriage to the operative position for the feeding and distributing means will move the molding press to a position in which it can take up the stacked molding rings and the ram of the press can then be lowered to a position in which the uppermost molding ring of said stack can be taken up by the retaining coupling provided on said ram.

DETAILED DESCRIPTION OF THE PREFERRED EMBODIMENT

Figure 1:
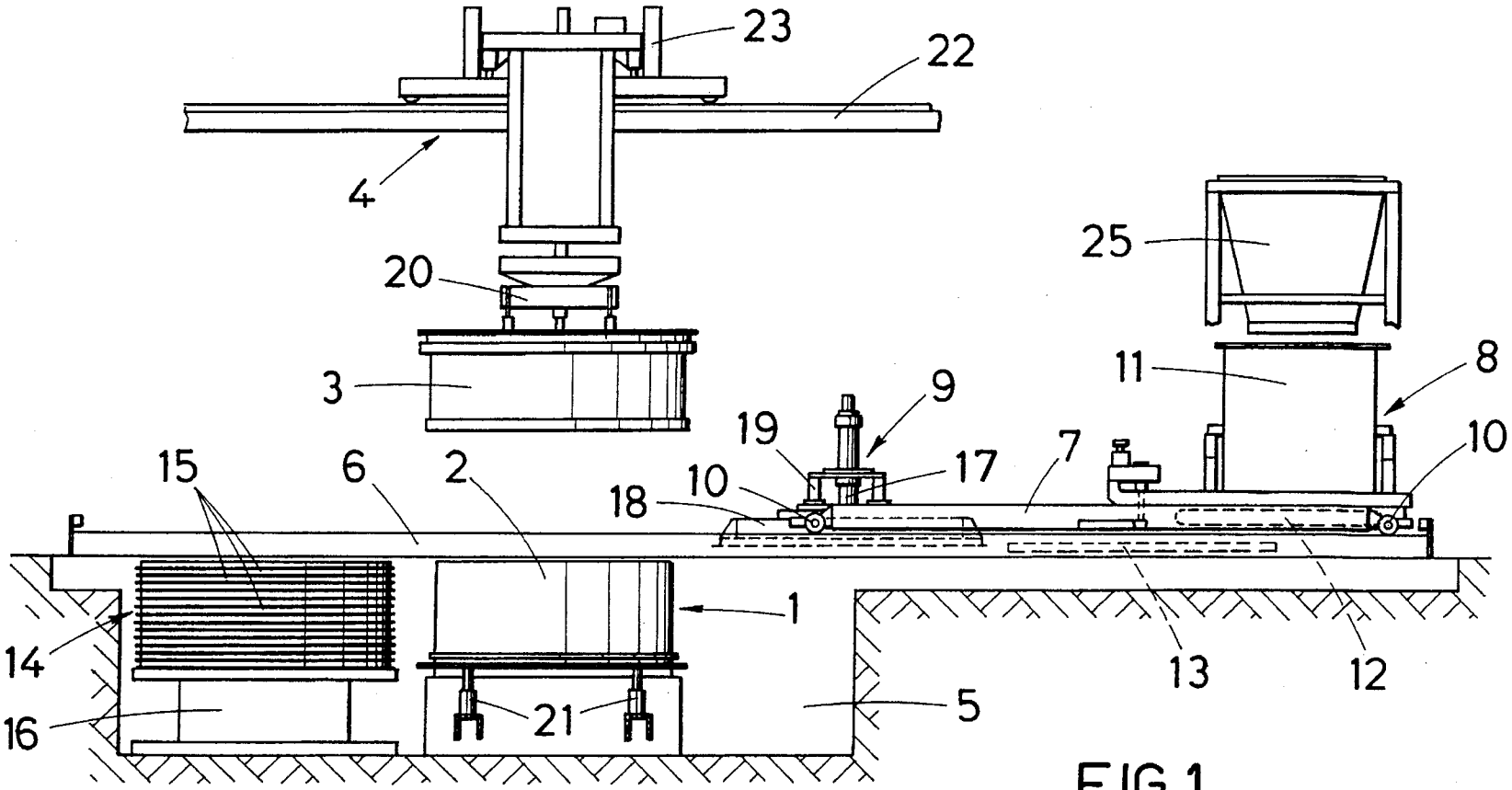
FIG. 1 is a schematic side elevation showing an apparatus in accordance with the invention for manufacturing annular or tubular workpieces form concrete.

The subject matter of the invention will now be described more in detail by way of example with reference to the drawing.

The illustrated apparatus comprises molding means 1, which have a vertical axis and comprise a core 2 provided with vibrating means and a shell 3, which surrounds and is radially spaced from the core 2 and by means of an extracting crane 4 can axially be lowered to a position around the core 2 and together with the workpiece malded between the core 2 and the shell 3 can be lifted from the core 2. As is particularly apparent from FIG. 1 the molding means 1 are disposed in a pit 5 and rails 6 for a carriage 7 are provided on both longitudinal sides of said pit 5. On the carriage 7, feeding and distributing means 8 for the concrete and a molding press 9 are arranged one behind the other in the direction in which the carriage 7 is displaceable. The carriage 7 is guided by means of rollers 10, which roll on the rails 6. Racks for driving the carriage 7 extend along the rails 6 and mesh with pinions, which are rotatably mounted on the carriage 7 and driven by gearmotors.

The feeding and distributing means 8 comprise a supply bin 11 for the concrete. That bin 11 is disposed above a conveyor belt 12, which has a discharge end that is disposed over a distributing turntable 13 so that the concrete which is delivered by the conveyor belt 12 from the supply bin 11 to the distributing turntable 13 can be dispensed in a uniform distribution around the periphery of the molding means 1 into the mold cavity, which is defined by the core 2 and the shell 3. For that purpose the carriage 7 must be displaced from its initial position shown in the drawing to an operative position for charging. In that charging position the axis of rotation of the distributing turntable 13 coincides with the vertical axis of the molding means. At the same time the molding press 9 is displaced beyond the molding means 1 to the opposite side to a position over a stack 14 of molding rings 15. That stack 14 has been deposited on a suitable support 16. The ram 17 of the molding press 9 is then lowered so that a retaining coupling 18 provided on the ram 17 takes a molding ring 15 form the stack 14 of molding rings. After the mold cavity of the molding means 1 has been filled with concrete that molding ring 15 is used to mold the top end face of the workpiece. For that purpose the carriage 7 must be pushed back to the operative or molding position for the molding press 9 so that the axis of the ram of the molding press coincides with the axis of the molding means. When the molding press 9 is in that operative position the press frame 19 is indirectly or directly locked to the molding means 1 so that the forces exerted by the press need not be taken up by the carriage 7 when the molding ring is inserted into the annulat ear gap between the core 2 and the shell and is forced into the concrete filled into said space. The molding ring is preferably rotated as it is forced into said concrete.

Figure 2:
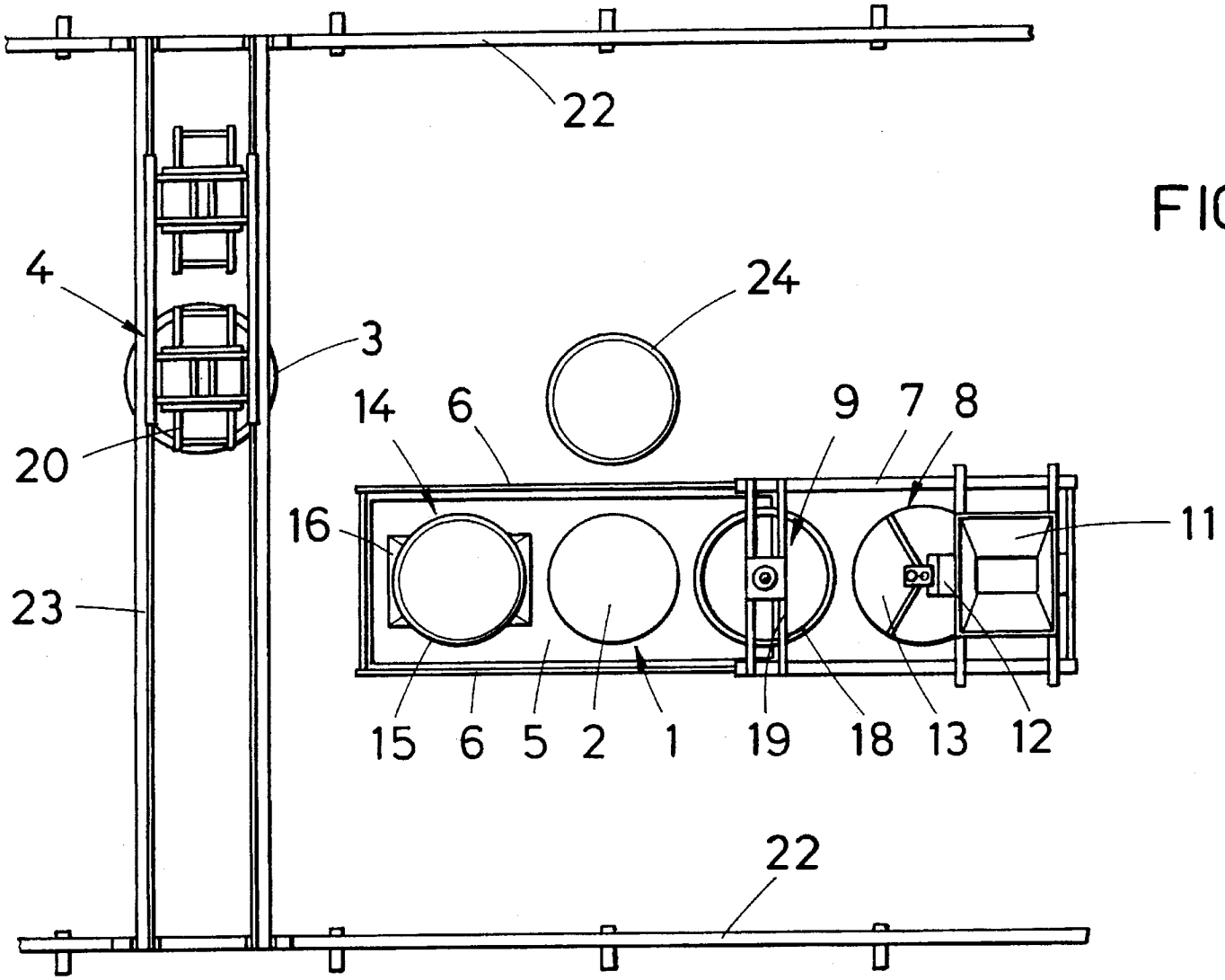
FIG. 2 is a top plan view showing that apparatus on a smaller scale.

When it is desired to extract the workpiece, the carriage 7 is moved back to its initial position shown in the drawing and the shell 3 together with the molded workpiece is then gripped by the load-carrying means 20 of the extracting crane 4 and can be lifted from the core 2. That extracting of the workpiece may be assisted by a hydraulic extracting aid 21 of the molding means 1. The bridge 23 of the extracting crane 4 may then be moved on crane rails 22 to move the extracted workpiece to a hardening station, where the shell 3 is pulled from the workpiece. To prepare for the manufacture of a new workpiece, it is necessary to connect to the bottom of the shell 3 or of a new shell a molding ring 24, which serves to close the mold cavity of the molding means 1 at its bottom before the shell 3 provided with the bottom molding ring is positioned around the core 2 of the molding means 1. The bottom molding rings 24 may be taken from a stack of molding rings, which stack is disposed laterally of the core 2 of the molding means 1, as is indicated in FIG. 2.

During the extraction of the workpiece the supply bin 11 of the feeding and distributing means 8 may be refilled form a stationary silo 25 for concrete so that the carriage 7 can be displaced to the operative position for the feeding and distributing means after the shell 3 provided with the bottom molding ring 14 has been positioned around the core 2 of the molding means 1. Thereafter the described sequence of operations can be repeated for manufacturing a new workpiece.

I claim:

1. In an apparatus for manufacturing open-ended hollow workpieces from concrete, comprising molding means, which have a vertical axis and comprise a core and a shell, which surrounds and is radially spaced from said core and defines with said core an open-topped mold cavity, feeding and distributing means, which extend above said molding means and are guided to be radially displaceable relative to said molding means and adapted to dispense concrete into said mold cavity, and a molding press, which extends above said molding means and comprises a vertical ram that is adapted to carry at its bottom end a molding ring for closing said mold cavity at its top, which press is radially displaceable relative to said molding means, the improvement residing in that a carriage is provided, which extends above said molding means and is guided to be radially reciprocable in a predetermined direction relative to said molding means, and said feeding and distributing means and said molding press are mounted on said carriage and are arranged one behind the other in said predetermined direction.

2. The improvement set forth in claim 1, wherein rails disposed on both sides of said molding means are provided for guiding said carriage in said predetermined direction.

3. The improvement set forth in claim 1 wherein said ram is provided at its bottom end with a disengageable coupling for retaining said molding ring, wherein said carriage is movable in said predetermined direction to a molding position, in which said molding press is vertically aligned with said molding means and said feeding and distributing means are disposed on one side of said vertical axis, and to a charging position, in which said feeding and distributing means are adapted to dispense concrete into said mold cavity and said molding press is disposed on the other side of said vertical axis, an a support for carrying a stack of molding rings is provided, which is arranged to be vertically aligned with said molding press when said carriage is in said charging position.

4. The improvement set forth in claim 3, wherein said support is spaced from said molding means by a distance which equals the distance by which said molding press is spaced from said feeding and distributing means in said predetermined direction.

* * * * *